US008336444B2

(12) United States Patent
Imamura et al.

(10) Patent No.: US 8,336,444 B2
(45) Date of Patent: Dec. 25, 2012

(54) HYDRAULIC CYLINDER

(75) Inventors: Kazuya Imamura, Hiratsuka (JP); Kuniaki Nakada, Hiratsuka (JP); Noboru Kanayama, Hiratsuka (JP); Mitsuo Yabe, Hiratsuka (JP); Tomoya Watanabe, Hiratsuka (JP); Teruyuki Hosoya, Koriyama (JP)

(73) Assignee: Komatsu Ltd., Tokyo (JP)

( * ) Notice: Subject to any disclaimer, the term of this patent is extended or adjusted under 35 U.S.C. 154(b) by 897 days.

(21) Appl. No.: 11/918,183

(22) PCT Filed: Apr. 11, 2006

(86) PCT No.: PCT/JP2006/307634

§ 371 (c)(1),
(2), (4) Date: May 8, 2009

(87) PCT Pub. No.: WO2006/109794

PCT Pub. Date: Oct. 19, 2006

(65) Prior Publication Data

US 2010/0300283 A1 Dec. 2, 2010

(30) Foreign Application Priority Data

Apr. 11, 2005 (JP) ..... 2005-113125

(51) Int. Cl.
*F15B 15/22* (2006.01)

(52) U.S. Cl. ..... 92/85 R; 91/396

(58) Field of Classification Search ..... 92/85 R, 92/85 A; 91/394, 396, 405, 409
See application file for complete search history.

(56) References Cited

U.S. PATENT DOCUMENTS 4,642,995 A * 2/1987 Bachler et al. ..... 92/85 A

FOREIGN PATENT DOCUMENTS

| | | |
|---|---|---|
| JP | 49-8693-01 | 4/1947 |
| JP | 53-73395 | 11/1951 |
| JP | 55-41629 | 9/1953 |
| JP | 2593094 | 1/1999 |
| JP | 11-189090 | 7/1999 |
| JP | 2004-332778 | 11/2004 |

* cited by examiner

*Primary Examiner* — Michael Leslie
(74) *Attorney, Agent, or Firm* — Fish & Richardson P.C.

(57) ABSTRACT

A pressure-receiving face plate 29 is mounted on one end face of a piston 12, and a support member 26 is raised on the end face of the piston 12. Disposed on the support member 26 with an allowance are, from the pressure-receiving faceplate 29 respectively, a disk spring 27, a plate 25, and a plunger 28. A flange 26*a* prevents these members from slipping off the support member 26. When the piston 12 approaches a stroke end, the plunger 28 is inserted in an oil passage 20*b* and applies a cushioning effect to the piston 12. In addition, a gap between the pressure-receiving faceplate 29 and the plate 25 brought into contact with a cylinder bottom 17 becomes narrow, and produces a squeeze effect such that oil escapes from the narrow gap. This makes it possible to provide a hydraulic cylinder that produces a sufficient impact force at the stroke end of the piston and also reduces noise emitted by the impact force, without increasing a length of the hydraulic cylinder.

21 Claims, 11 Drawing Sheets

HYDRAULIC CYLINDER

TECHNICAL FIELD

The present invention relates to a hydraulic cylinder, and more particularly to a hydraulic cylinder that can produce an impact force at a stroke end of a piston and reduce noise emitted by the impact force.

BACKGROUND ART

Conventionally, for example, a hydraulic excavator dumps soil, sand, or the like in a bucket by contracting a hydraulic cylinder for the bucket, thereby turning an opening side of the bucket downward. In addition, when the hydraulic cylinder for the bucket is contracted, a piston is struck against the bottom of a cylinder tube at the stroke end of the piston to thereby cause soil, sand, or the like sticking to an inside of the bucket to fall by an impact force produced as a result of striking.

However, the impact force resulting from striking produces vibrations, which propagate to a periphery of the hydraulic cylinder and cause loud noise. More than one such impact may occur in a short time due to an elasticity of a bucket link, which may result in emitting much noise.

In order to eliminate noise, a hydraulic cylinder having a cushioning device is used. In such a hydraulic cylinder with the cushioning device, a piston slowly comes into contact with a cylinder tube at the stroke end of the hydraulic cylinder for the bucket under contraction. As a result, a sufficient impact force is not applied to the bucket and, accordingly, soil, sand, or the like sticking to the inside of the bucket do not fall.

To overcome the problems described above, a hydraulic cylinder (refer to Patent Document 1) has been proposed that produces impact forces at the stroke end of a piston and, moreover, reduces noise. In addition, to reduce noise at the stroke end of a piston, a load-bearing platform storage device (refer to Patent Document 2) and so on have been proposed.

FIG. 14 is a cross-sectional view of a configuration of the hydraulic cylinder described in Patent Document 1 as a first conventional example related to the present invention. The hydraulic cylinder 50 shown in FIG. 14 is the hydraulic cylinder 50 for the bucket. The hydraulic cylinder 50 includes a cylinder tube 51, a piston 52, and a cylinder rod 53. The bucket (not shown) is pivotally supported on a leading end of the cylinder rod 53. A trailing end of the cylinder tube 51 is pivotally supported on an arm (not shown).

The cylinder rod 53 is extended by supplying pressure oil to an oil chamber 54 on a bottom side of the cylinder tube 51. In addition, the cylinder rod 53 is contracted by supplying pressure oil to a oil chamber 55 on a head side. Extension and contraction of the cylinder rod 53 enables the bucket (not shown) to be rotated.

A configuration of the cylinder tube 51 is such that a cylinder bottom 57 and a cylinder head 58 are attached to a cylindrical body 56. The cylinder rod 53 projects beyond a hole 59 defined in the cylinder head 58. In addition, formed in the cylinder bottom 57 and the cylinder head 58 are passages 57*a* and 58*a* respectively.

The piston 52 of the hydraulic cylinder 50 is provided with a vibration attenuation member 60 which strikes against the cylinder bottom 57 at the stroke end and also attenuates vibration produced by striking. A configuration of the vibration attenuation member 60 is such that a block body 61 of a damping metal substance is attached to the piston 52 on a side of the cylinder bottom 57. At the stroke end of a contraction, the block body 61 comes into contact with the cylinder bottom 57. An example of the damping metal composing the block body 61 is Mn-0.22Cw-0.05Ni-0.02Fe.

In this configuration, when the hydraulic cylinder 50 for the bucket is contracted and the piston 52 reaches the stroke end, the block body 61 strikes against the cylinder bottom 57. The striking of the block body 61 against the cylinder bottom 57 is transmitted to the cylinder rod 53 as an impact force, which is consequently applied to the bucket. The impact force from the cylinder rod 53 is adequate to cause soil, sand, or the like sticking to the inside of the bucket to fall.

In addition, vibration produced by the striking of the block body 61 against the cylinder bottom 57, especially high frequency components of the vibration, can be absorbed and attenuated by the damping metal composing the block body 61. Specifically, a use of the damping metal prevents vibration generated by an impact from propagating to the piston 52, cylinder rod 53, and cylinder tube 51, that is, the periphery of the hydraulic cylinder, thus reducing the emission of noise.

FIG. 15 is a cross-sectional view of the load-bearing platform storing device described in Patent Document 2, which is a second conventional example related to the present invention. Specifically, FIG. 15 is a cross-sectional view of a cylinder 70 for upright or horizontal position which is mounted to aback of a load-bearing platform (not shown). By extending or contracting the cylinder 70 for upright or horizontal position, the load-bearing platform can be brought into an upright stored position or a horizontal projecting position. In the horizontal projecting position, a worker can carry goods or the like into or from a luggage compartment of a freight car via the load-bearing platform. In the upright stored position, the luggage compartment is closed.

In a typical load-bearing platform storage device, when its load-bearing platform is rotated upward from a horizontal projecting position to an upright stored position, a rotation moment at an initial stage of a rotation is large and, therefore, the load bearing platform is slowly rotated upward. However, as the rotation moment decreases with further upward rotation of the load-bearing platform, the load-bearing platform gradually increases its rotating speed and stands upright. For this reason, in the upright stored position where the rotation moment does not act, the speed of the rotation is highest. Consequently, in the upright stored position, the load-bearing platform strikes against a platform storage chamber or the like, and stops while emitting loud noise, which is a problem.

In order to solve the problems discussed above, the load-bearing storage device described in Patent Document 2 has been proposed. As shown in FIG. 15, disposed in a cylinder main body 71 of the cylinder 70 for the upright or horizontal position is a piston 73 which is freely slidable and fixed to a basal end of a rod 72. When operational hydraulic oil is supplied to an oil supply/exhaust port 74 formed in a bottom of the cylinder main body 71, the piston 73 can slide toward the head by the pressure of the operational hydraulic oil so as to extend the rod 72. A plurality of disk springs 75 are disposed inside the rod 72 on a head side of the cylinder main body 71.

When the cylinder 70 for upright or horizontal position is extended, a reaction force of the disk springs 75 does not act as extension begins. However, when the piston 73 slides toward the head and comes into contact with the disk springs 75, the reaction force of the disk spring 75 acts on the piston 73. This decelerates an extending operation of the cylinder 70 for the upright and horizontal position, so that a load-bearing platform (not shown) slowly becomes upright. When the disk springs 75 are compressed to a predetermined degree L, the cylinder 70 for upright or horizontal position reaches its maximally extended state so that the load-bearing platform is stored upright. Accordingly, in the upright stored position, the load-bearing platform slowly comes into contact with the storage chamber and stops without emitting loud impact noise.

[Patent Document 1] Japanese Patent Application Laid-Open Publication No. 2004-332778

[Patent Document 2] Japanese Patent Application Laid-Open Publication No. 11-189090

DISCLOSURE OF THE INVENTION

Problem to be Solved by the Invention

The hydraulic cylinder described in Patent Document 1 may produce an impact force at the stroke end of the piston 52 and also reduce noise. Moreover, altering a thickness of the block body 61 of the damping metal substance attached to the cylinder bottom 57 of the piston 52 allows an alteration of a logarithmic decrement rate of vibration generated by impact, in other words, time taken to attenuate noise.

This means that increasing a degree of noise attenuation per unit of time requires an increase in the thickness of the block body 61. However, if the block body 61 is formed thicker, a stroke distance of the piston 52 becomes shorter. In order to ensure sufficient stroke distance of the piston 52, a length of the cylinder tube 51 must be increased.

The load-bearing platform storage device described in Patent Document 2 is designed to reduce the impact force at a strike of the piston 73 at the stroke end. By reducing the impact force, the emission of noise is reduced. However, where the cylinder 70 described in Patent Document 2 is used as a hydraulic cylinder for moving the bucket of a hydraulic excavator, the impact force at the stroke end is attenuated. This results in impact force insufficient to cause soil, sand, or the like sticking to the inside of the bucket to fall.

In order to greatly attenuate the impact force so that noise at the stroke end is reduced, more disk springs 75 are required. If more disk springs 75 are used, the stroke distance of the piston 73 becomes shorter. To ensure sufficient stroke distance of the piston 73, a length of the cylinder main body 71 must be constructed to be longer. If fewer disk springs 75 are used, a greater impact force at the stroke end is ensured, which results in louder noise.

It is, accordingly, an object of the invention to provide a hydraulic cylinder that can produce a sufficient impact force at the stroke end of a piston and also reduce noise emitted by the impact force, without increasing the length of the hydraulic cylinder.

Means for Solving the Problems

The object of the present invention can be accomplished by inventions described in claims 1 to 8.

In a first invention, a most notable feature is that there is provided a hydraulic cylinder comprising a piston fitted within a cylinder so as to be slidable and a piston rod to one end of which the piston is fixed, wherein a plate is disposed on a side of at least one of both end faces of the piston so as to be slid integrally with the piston, and can be brought into contact with and separated from the one end face with a face of the plate being substantially parallel to the one end face; sliding of the plate is regulated relative to sliding of the piston at a stroke end of the piston; and a narrow gap is defined between the one face of the plate and the end face of the piston opposite the plate by the regulation of the sliding of the plate.

In a second invention, amain feature is that a restoring mechanism is provided for restoring a gap between the face of the plate and the end face of the piston opposite to the plate to a desired width.

Further, in third and fourth inventions, each main feature is that a configuration of the restoring mechanism is specified.

In a fifth invention, amain feature is that a configuration of the plate is specified.

In a sixth invention, amain feature is that a configuration for a return stroke of the piston is specified.

In a seventh invention, a main feature is that a configuration for applying a cushioning effect at the stroke end of the piston is specified.

In an eighth invention, a most notable feature is that there is provided a hydraulic cylinder comprising a piston fitted within a cylinder so as to be slidable and a piston rod to one end of which the piston is fixed, wherein a support member extending from one end face of the piston in an axial direction is provided at least on one end face of both end faces of the piston; a plate is supported by the support member so that one face of the plate is brought into contact with or separated from the end face on which the support member is provided, with the one face of the plate being in a substantially parallel state, the plate being capable of sliding integrally with the piston and capable of relatively sliding in the axial direction with respect to the piston, sliding of the plate is regulated in relation to sliding of the piston at the stroke end of the piston, and a narrow gap is defined between the one face of the plate and the end face of the piston opposite to the plate by a regulation of the sliding of the plate.

Effects of the Invention

In the present invention, when the plate slides toward the stroke end together with the piston, one face of the plate comes into contact with a bottom portion of the cylinder or the like at the stroke end. Thereafter, the piston can continue sliding; but the plate remains in contact with the bottom portion or the like and cannot move with the piston. As a result, the gap between the face of the plate and the end face of the piston, which are opposite to each other, becomes narrow.

When the gap between the face of the plate and the end face of the piston is narrow, pressure oil existing between the face of the plate and the end face of the piston is squeezed and escapes from the gap. When the pressure oil is squeezed and escapes from the narrow gap, a shearing force due to friction is produced between each wall face of the face of the plate and the end face of the piston, which are opposite to each other, and the oil Since the oil escapes from the gap as a result of overcoming the shearing force, high pressure arises between the face of the plate and the end face of the piston. This phenomenon is generally known as a squeeze effect.

In the present invention, a mechanism for causing the squeeze effect is constructed within a cylinder. This construction allows the piston to suddenly stop at the stroke end. In addition, since the piston strikes against the cylinder through a oil film, this construction contributes to a reduction in vibration generated by striking. This ensures an impact force produced by the sudden stop of the piston and also reduces noise emitted due to vibration caused by striking.

To be specific, in the present invention, the plate sliding together with the piston can be stopped at the stroke end, and the gap between the face of the plate and the end face of the piston that are disposed opposite to each other can be made even narrower by further sliding of the piston. Such a narrow gap produces the squeeze effect described above.

The hydraulic cylinder according to the present invention is able to stop the piston gently in comparison with a hydraulic cylinder that does not produce any squeeze effect. Accordingly, vibration generated by impact occurring with the stopping of the piston can be reduced. Moreover, since the piston strikes against the cylinder through an oil film, an impact force propagating to a side of the cylinder is lessened. This makes it possible to reduce vibration and noise resulting from the striking of the piston against the cylinder at the stroke end.

In particular, a squeeze effect arises in a very short period before the piston stops. Accordingly, where a hydraulic cylinder according to the present invention is used to operate the bucket of, for example, a hydraulic excavator, a sufficient impact force applied to the bucket can be secured. This causes soil, sand, or the like sticking to the inside of the bucket to fall and does not degrade its ability to drop a soil.

In addition, compare with a hydraulic cylinder equipped with a plunger type cushion which applies a cushioning effect at the stroke end of the piston, an impact force applied to a bucket by the hydraulic cylinder according to the invention is greater. Accordingly, the ability to drop the soil is improved.

In the hydraulic cylinder according to the present invention, the plate may be held by a support member disposed at the end face of the piston. Holding the plate by the support member makes it possible to bring one face of the plate into contact with or separate it from the end face of the piston substantially in parallel to the end face of the piston. The substantially parallel contact or separation is also stable. Accordingly, an effective squeeze effect can be produced.

EXPLANATION OF REFERENCE NUMERALS

7 BUCKET
8 HYDRAULIC CYLINDER
11 CYLINDER TUBE
12 PISTON
13 PISTON ROD
17 CYLINDER BOTTOM
18 CYLINDER HEAD
25 PLATE
26 SUPPORT MEMBER
27 DISK SPRING
28 PLUNGER
29 PRESSURE-RECEIVING FACEPLATE
30 PERFORATION
31, 31' CROSS-SHAPED GROOVE
32 COIL SPRING
33 ELASTIC FLAP
34 OIL GROOVE
35 PLATE
37 DISK SPRING
39 GROOVE
50 HYDRAULIC CYLINDER
51 CYLINDER TUBE
52 PISTON
53 CYLINDER ROD
57 CYLINDER BOTTOM
58 CYLINDER HEAD
60 VIBRATION ATTENUATION MEMBER
61 BLOCK BODY
70 CYLINDER FOR UPRIGHT OR HORIZONTAL POSITION
71 CYLINDER MAIN BODY
72 ROD
73 PISTON
75 DISK SPRING

BEST MODE FOR CARRYING OUT THE INVENTION

Referring to accompanying drawings, preferred embodiments of the invention will be described in detail. The description below exemplifies a case where a hydraulic cylinder according to the invention is used as a hydraulic cylinder for operating a bucket of a hydraulic excavator. A configuration of the hydraulic cylinder described below covers various equivalent shapes and arrangements other than those described below as long as they can accomplish the objects of the invention. Accordingly, the invention is not limited to the embodiments below but may be variously modified.

First Embodiment

Figure 1:
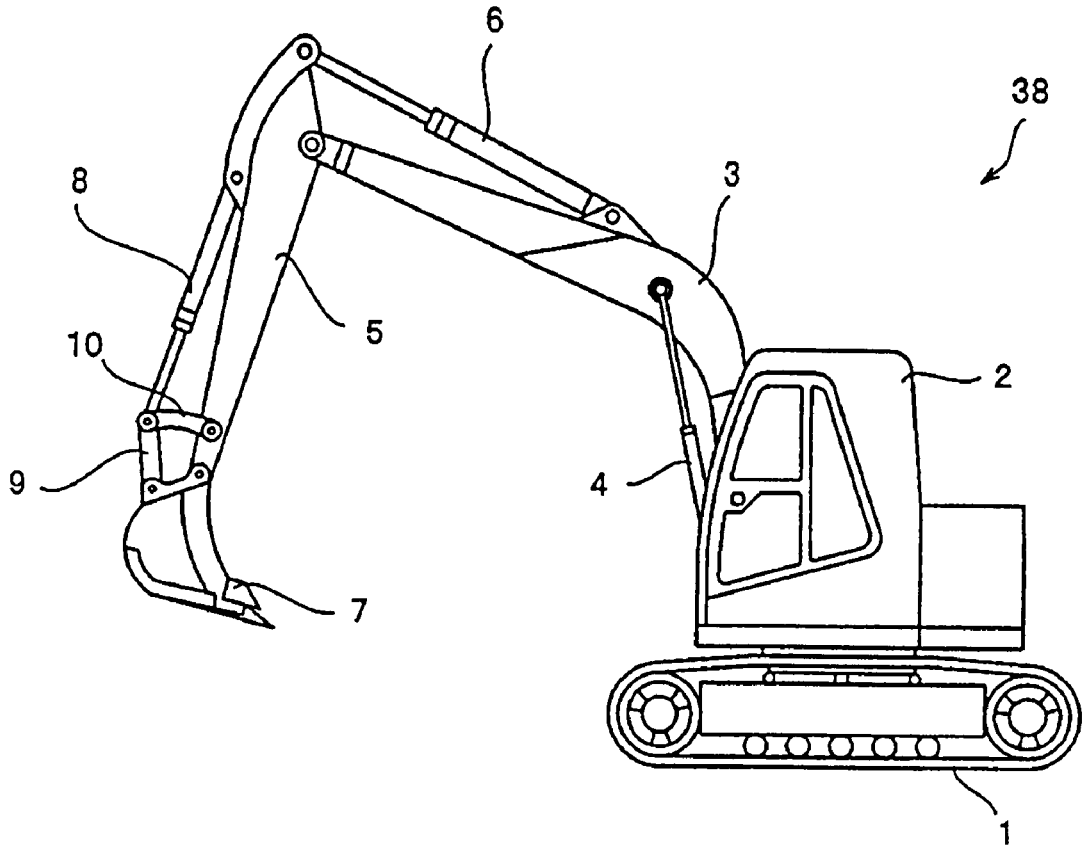
FIG. 1 is a side view of a hydraulic excavator. (Embodiments)

FIG. 1 is a side view of a hydraulic excavator using a hydraulic cylinder according to the invention. The hydraulic excavator 38 includes an undercarriage 1 and an upper revolving body 2 mounted on the undercarriage 1 so as to freely revolve. Supported on the upper revolving body 2 are, from a side of the upper revolving body 2 respectively, a boom 3, an arm 5, and a bucket 7, all of which are capable of freely swinging or turning.

The boom 3 pivotally supported on the upper revolving body 2 is vertically freely swung by a hydraulic cylinder 4 for a boom 3. The arm 5 supported on a leading end of the boom 3 can be operated by a hydraulic cylinder 6 for the arm 5 so as to be vertically freely swung. The bucket 7 supported on a leading end of the arm 5 can be operated by a hydraulic cylinder 8 for the bucket 7 and first and second bucket links 9 and 10 so as to be vertically freely turned.

An operation of extending the hydraulic cylinder 8 for the bucket 7 allows the bucket 7 to be turned in a direction in which soil, sand, or the like is dug or scooped. An operation of contracting the hydraulic cylinder 8 allows the bucket 7 to dump soil, sand, or the like therefrom. By striking the piston of the hydraulic cylinder 8 against a cylinder tube at a stroke end during the operation of contracting the hydraulic cylinder 8, an impact force can be generated. The impact force is transmitted to the bucket 7, thereby causing soil, sand, or the like, sticking to an inside of the bucket, to fall. In the description of the first embodiment, "cylinder tube" is a term used to refer to a cylindrical part of each hydraulic cylinder.

Figure 2:
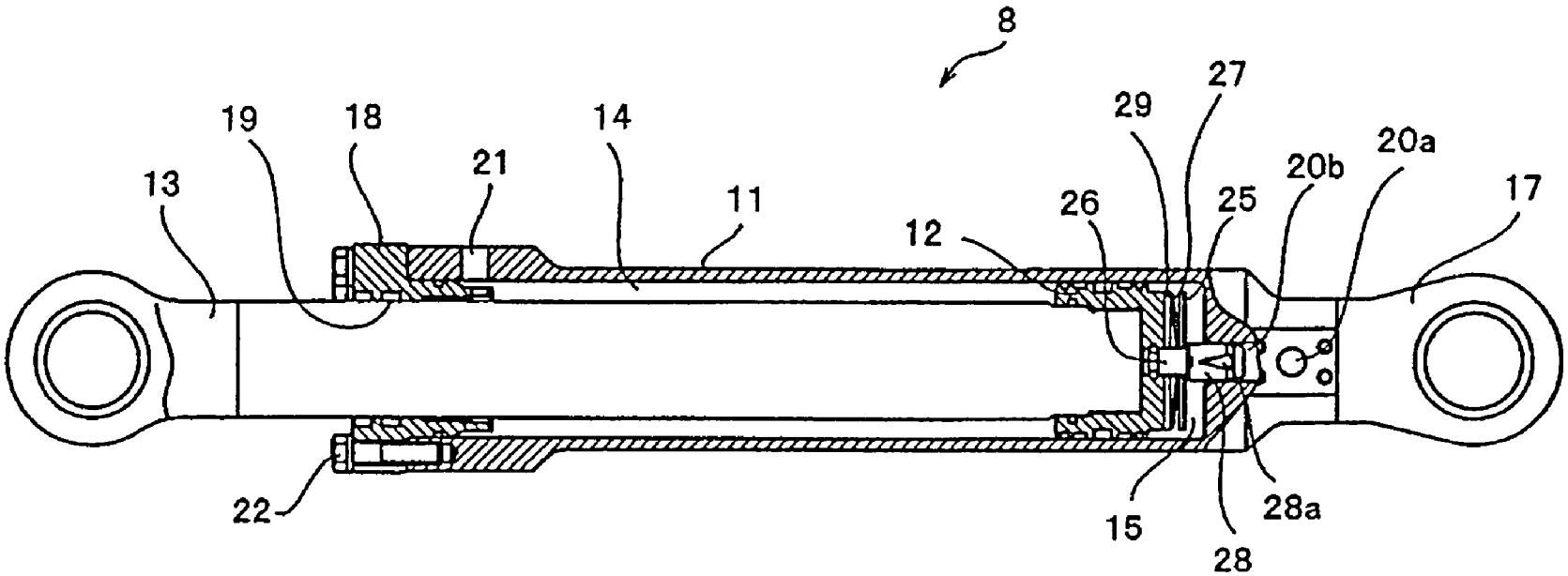
FIG. 2 is a cross-sectional view of a hydraulic cylinder. (First embodiment)

FIG. 2 is a cross-sectional view of the hydraulic cylinder 8 for the bucket 7. The hydraulic cylinder 8 comprises the above-mentioned cylinder tube 11, a piston 12, and a piston rod 13. A cylinder head 18 is firmly fixed to one end of the cylinder tube 11 by a bolt 22, while a cylinder bottom 17 is welded to its other end. Formed in an internal face of the cylinder head 18 is a sealing groove 19.

Disposed in the cylinder tube 11 is a piston 12, which freely slides backward or forward. The piston 12 is firmly fixed to the piston rod 13 passing through the cylinder head 18. Pressure oil can be supplied to an oil chamber 14 on a cylinder head side via an oil passage 21. Pressure oil can also be supplied to an oil chamber 15 on a bottom side via oil passages 20*a* and 20*b* formed in the cylinder bottom 17.

Attached to the piston 12 on a side of the cylinder bottom 17 is a support member 26 extending in an axial direction of the piston 12 from a center of the piston 12. Disposed on the support member 26 are, from a side of the end face of the piston 12 respectively, a pressure-receiving faceplate 29 attached to the end face of the piston 12, a disk spring 27, a plate 25, and a plunger 28. The disk spring 27, the plate 25, and the plunger 28, other than the pressure-receiving faceplate 29, fit on the support member 26 with an allowance, and are held by a flange 26*a* formed at an end of the support member so as not to slip off.

The plunger 28 can engage with the oil passage 20*b* open in the cylinder bottom 17 so as to be freely inserted into or drawn from the oil passage 20*b*. Upon a supply of the pressure oil from the oil passage 21, the piston 12 slides toward the side of the cylinder bottom 17. When the plunger 28 is inserted in the oil passage 20*b* at the stroke end of the piston 12, an amount of the pressure oil flowing out of the oil chamber 15 via the oil passage 20*b* is reduced. This effectively cushions a sliding of the piston 12.

Figure 3:
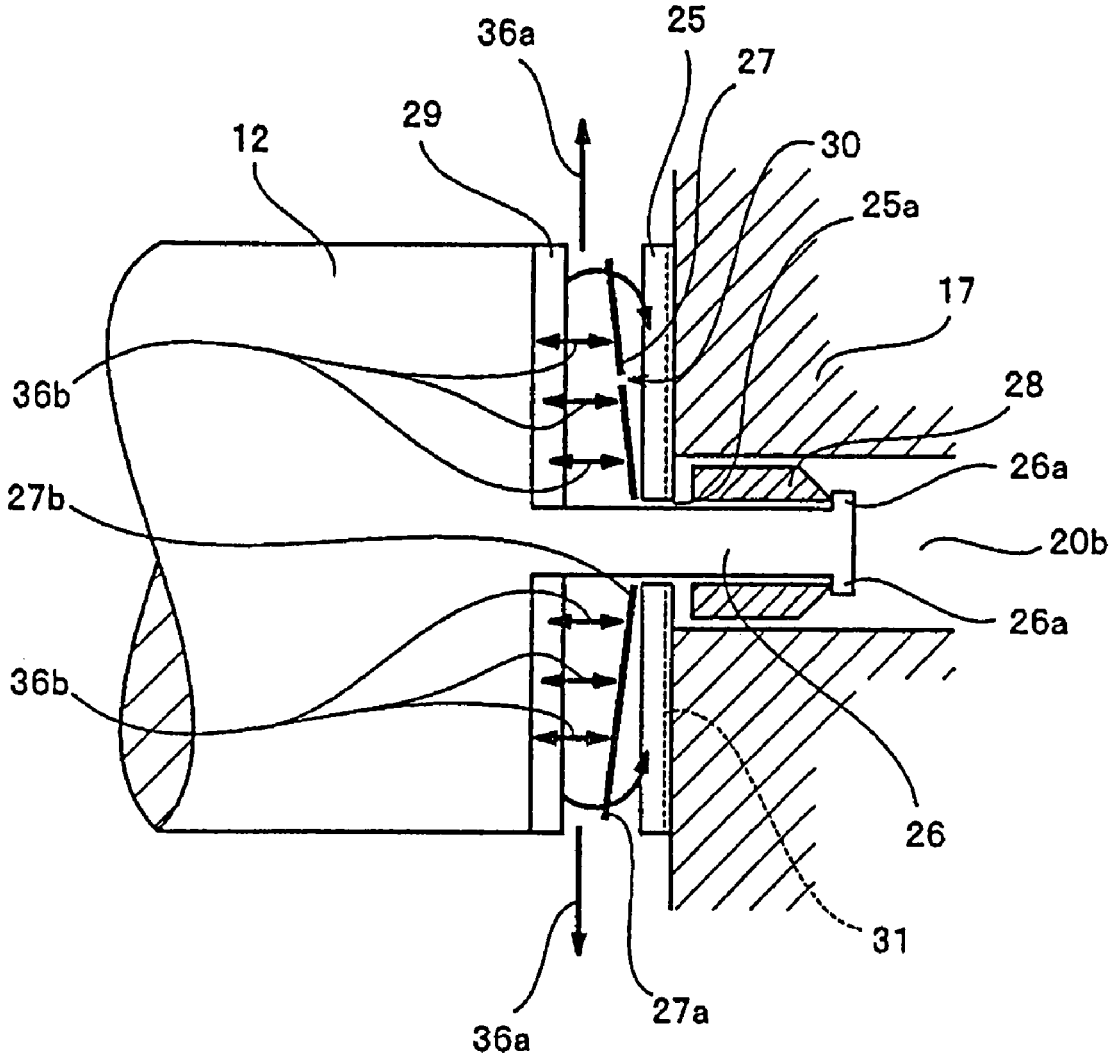
FIG. 3 is a schematic cross-sectional view of a main part of the hydraulic cylinder. (First embodiment)

FIG. 3 is a schematic view explaining an action of a squeeze effect produced by the plate 25, the disk spring 27, and the pressure-receiving faceplate 29. For a sake of easier explanation, FIGS. 3, 4, 5, and 6 exaggeratedly show positional relations between members. In addition, some members are omitted from these drawings.

When the piston 12 approaches the stroke end on the side of the cylinder bottom 17, the plate 25 comes into contact with the cylinder bottom 17. When the piston 12 slides further, the plate 25 approaches a side of a piston end while moving on the support member 26. At this time, an inner diameter portion 27*b* of the disk spring 27 comes into contact with the plate 25 by a movement of the plate 25 while its outer diameter portion 27*a* comes into contact with the pressure-receiving faceplate 29. Consequently, the disk spring 27 is deformed so as to be a flat plate state.

Thus, the disk spring 27 is deformed in a direction so as to stick to the plate 25. This decreases a gap between the disk spring 27 and the pressure-receiving faceplate 29 attached to the piston end and also another gap between the disk spring 27 and the plate 25.

When the piston 12 has reached the stroke end, the gap is narrow. Accordingly, as described above, oil escapes in a direction of arrows 36*a* from the narrow gap. Specifically, the oil escapes in the direction of the arrows 36*a* as a result of overcoming shearing force produced by friction between walls defining the gap and the oil. Consequently, high pressure shown by arrows 36*b* is produced between the walls defining the gap. This produces the squeeze effect.

The arrows shown in FIG. 3 indicate the squeeze effect produced between the disk spring 27 and the pressure-receiving faceplate 29. However, the squeeze effect can equally be produced between the disk spring 27 and the plate 25. The disk spring 27 functions not only to produce the squeeze effect but also to produce a restorative force after the gap between the face of the plate and the end face of the piston 12 become narrow at the stroke end. In other words, to allow the piston 12 to return, the disk spring 27 works as a restorative force such that the gap between the face of the plate and the end face of the piston is returned to a desired width.

The piston 12 is suddenly stopped by the squeeze effect. A sudden speed change of the piston 12 can be transmitted to the piston rod 13 as an impact force. Soil, sand, etc., sticking to the inside of the bucket is caused to fall by the impact force transmitted to the piston rod 13.

Additionally, when the piston 12 stops, a thin oil film is interposed between the piston 12 and the plate 25. This reduces impact and vibration resulting from the stopping of the piston 12, and hence reduces emission of noise.

Figure 4:
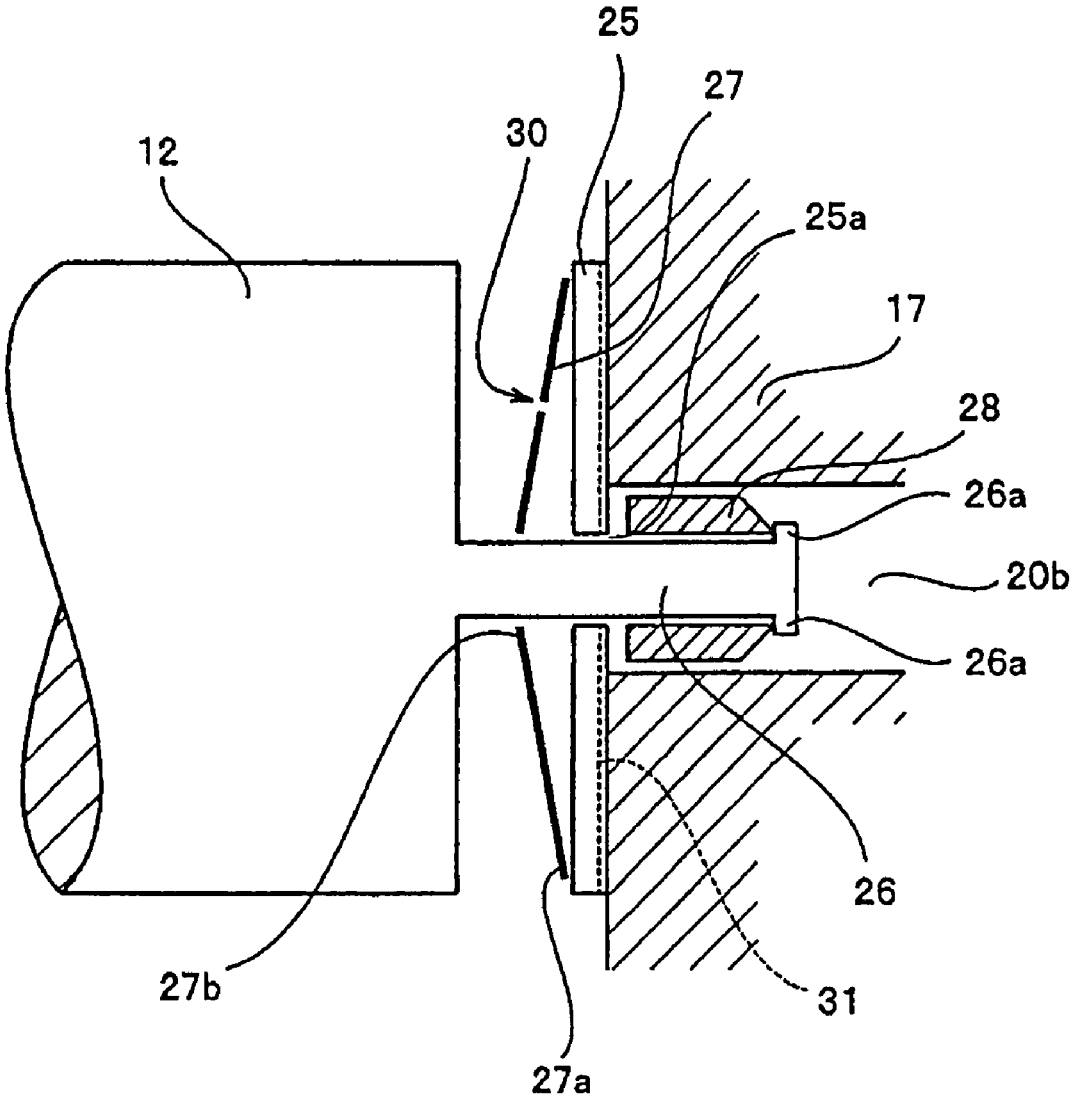
FIG. 4 is another schematic cross-sectional view of the main part of the hydraulic cylinder. (First embodiment)

A description has been given by exemplifying a case where the pressure-receiving faceplate 29 is attached to the end face of the piston 12. However, the pressure-receiving faceplate 29 is not necessarily a required member. As shown in FIG. 4, it is possible to omit the pressure-receiving faceplate 29 to be disposed on the piston 12 on a side of the disk spring 27.

In FIG. 4, the inner-diameter portion 27*b* of the disk spring 27 is disposed on a side of the end face of the piston 12, and the pressure-receiving faceplate 29 is not disposed. In FIG. 4, the pressure-receiving faceplate 29 may be disposed. As a direction of a disposal of the inner-diameter portion 27*b* of the disk spring 27, as shown in FIG. 3, it may be disposed on a side of the plate 25. Alternatively, in FIG. 3, the inner-diameter portion 27*b* of the disk spring 27 may be disposed on the side of the end face of the piston 12 as shown in FIG. 4.

As the piston 12 approaches the stroke end on the side of the cylinder bottom 17, the plate 25 comes into contact with the cylinder bottom 17. When the piston 12 slides further, the plate 25 approaches the side of the piston end while moving on the support member 26. The movement of the plate 25 deforms the disk spring 27 in a direction in which the disk spring 27 sticks to the end face of the piston 12.

Consequently, the gap between the disk spring 27 and the plate 25 decreases, with a result that a squeeze effect can be produced between the disk spring 27 and the plate 25. By disposing the disk spring 27 in positional relations shown in FIG. 4, the disk spring 27 can be deformed in the direction in which the disk spring 27 sticks to the end face of the piston 12. Accordingly, even where the end face of the piston 12 has a cross-shaped groove, this cross-shaped groove can be closed by a deforming of the disk spring 27, so that a squeeze effect can be efficiently produced between the disk spring 27 and the plate 25.

Figure 6:
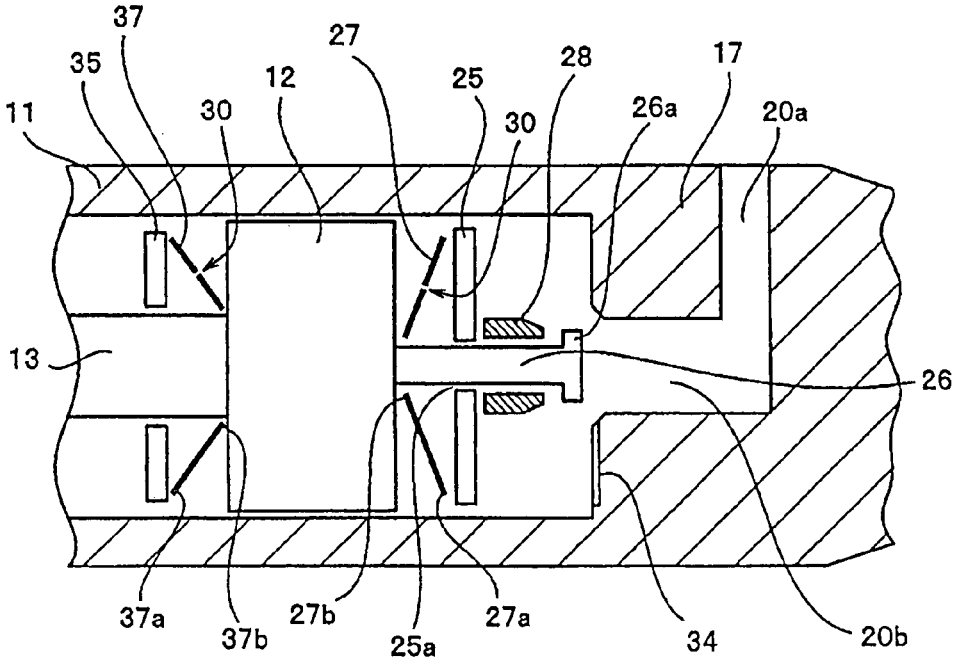
FIG. 6 is yet another schematic cross-sectional view of the main part of the hydraulic cylinder. (First embodiment)

As shown in FIG. 6, due to the narrow gap between the end face of the piston 12 and the plate 25, or between opposing faces including the disk spring 27 disposed between the end face of the piston 12 and the plate 25, it is possible to produce a squeeze effect.

In FIG. 6, another plate 35 is disposed on the side of the cylinder head 18 as well. Accordingly, a squeeze effect can be produced at the stroke end on the side of the cylinder head 18 as well. Disposed between the plate 35 and the piston 12 is another disk spring 37. The plate 35 and the disk spring 37 are capable of sliding on the piston rod 13.

As shown in FIG. 6, when the piston 12 slides toward the side of the cylinder head 18 by pressure oil supplied from the oil passages 20*a* and 20*b* and consequently the plate 35 comes into contact with the cylinder head 18, the sliding of the plate 35 stops. When the piston 12 slides further toward the side of the cylinder head 18, the gap between the plate 35 and the piston 12 becomes narrow.

Accordingly, when the piston 12 slides toward the side of the cylinder head 18 as far as the stroke end on the side of the cylinder head, a squeeze effect is produced in a same manner as the above-described squeeze effect produced on the side of the cylinder bottom.

In other words, at the stroke end of the piston 12 on the side of the cylinder head 18, an outer-diameter portion 37*a* of the disk spring 37 is in contact with the plate 35 while an inner-diameter portion 37*b* of the disk spring 37 is in contact with the end face of the piston 12. Further sliding of the piston 12 deforms the disk spring 37 in a flat plate state, which results in squeeze effects between the plate 35 and the disk spring 37 and between the disk spring 37 and the end face of the piston 12.

Figure 5:
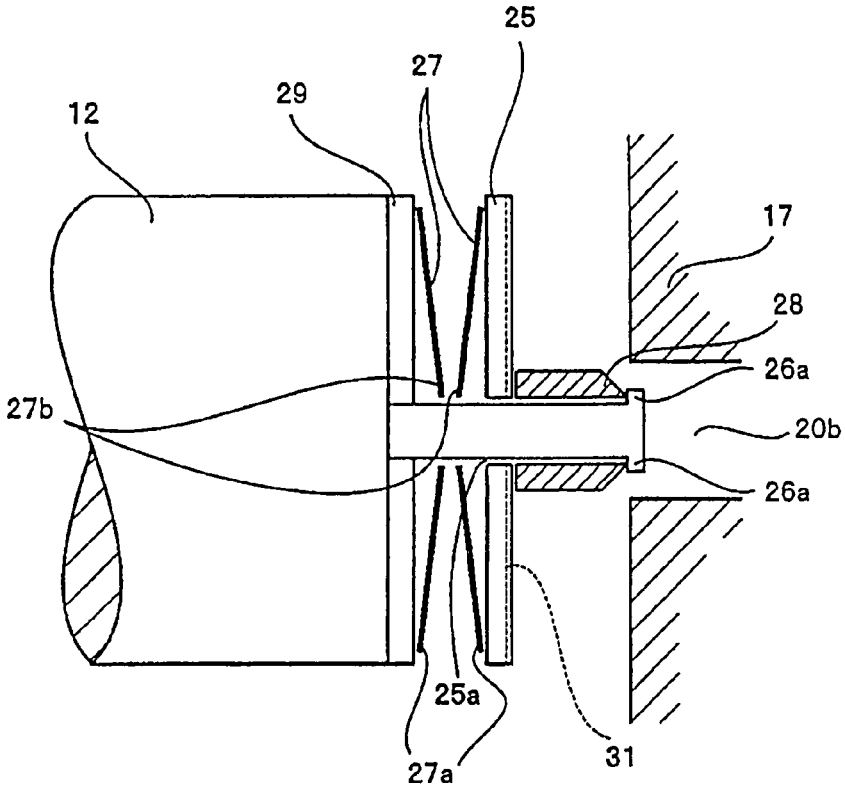
FIG. 5 is yet another schematic cross-sectional view of the main part of the hydraulic cylinder. (First embodiment)

As to a number of the disc spring 27, 37 to be disposed, A description has been given by exemplifying a case where one disk spring 27, 37 is disposed between the piston end and the plate 25, 35, respectively. However, the number of the disk springs 27, 37 is not limited to one, but two disk springs 27, 37 may be disposed, as shown in FIG. 5. Orientations of the inner-diameter portion 27*b*, 37*b* of the disk spring 27, 37 may be determined as necessity requires.

Although not shown, more than one disk spring may be disposed between the piston end and the plate 25, 35, a larger number of disk springs do not produce a marked improvement in squeeze effect. On the contrary, a larger number of disk springs may result in a shorter slide stroke of the piston. Therefore, it is preferable that an appropriate number of the disk springs be disposed.

Figure 11:
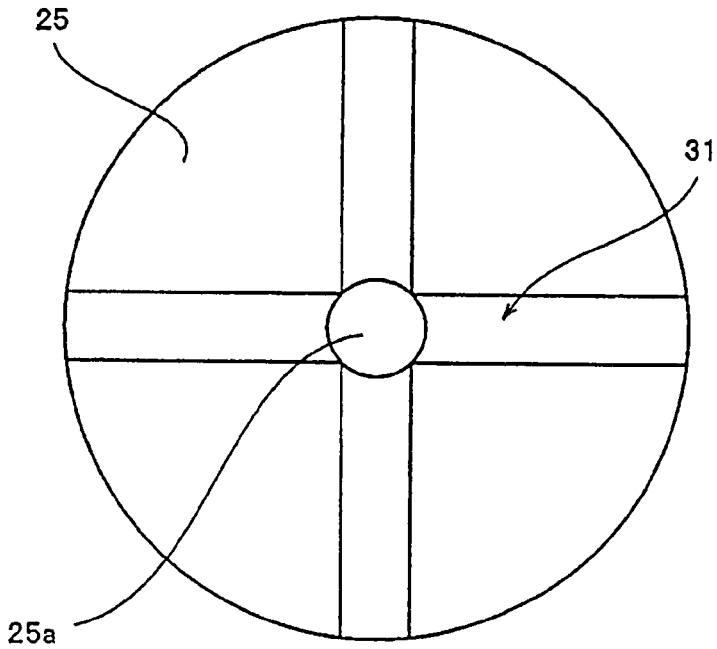
FIG. 11 is a front view of the plate (Embodiments)

As shown in FIGS. 3 to 5, a cross-shaped groove 31 is formed in a surface of the plate 25 on the side of the cylinder bottom 17. The cross-shaped groove 31 is formed, as shown in FIG. 11, in a radial direction with a hole 25*a* fitted on the support member 26 with an allowance as a center. When the piston 12 is at the stroke end on the side of the cylinder bottom 17, the plate 25 is in planar contact with the cylinder bottom 17.

In this case, if the cross-shaped groove 31 is not formed in the face of the plate 25, a pressure-receiving area subject to the pressure oil supplied from the oil passages 20*a* and 20*b* consists of only a pressure-receiving area of the plunger 28 and a pressure-receiving area acting on a part of the plate 25 near the oil passage 20*b* from the gap between the plunger 28 and the oil passage 20*b*. The piston 12 cannot slide toward the side of the cylinder head 18 unless the pressure in the oil passage 20*b* is high. In other words, when the pressure in the oil passage 20*b* has become high enough to slide the piston 12, the piston 12 can be slid.

However, in this case, once the piston 12 has been slightly slid, the high pressure oil uses an entire face of the end face of the piston 12 as the pressure receiving area, which causes the piston 12 to spring out. In order to prevent this spring-out phenomenon at a beginning of a piston movement, the cross-shaped groove 31 is formed in a pressure receiving face of the plate 25, thereby allowing the piston 12 to initiate movement smoothly.

The cross-shaped groove 31 allows the pressure oil from the oil passage 20*b* to be introduced in the cross-shaped groove 31. Consequently, as the pressure receiving area on which the oil passage 20*b* affect, in addition to the above-described pressure receiving area, an area of the cross-shaped groove 31 can be used as the pressure receiving area. Accordingly, the piston 12 can be slid toward the side of the cylinder head 18 before the pressure of the pressure oil in the passage 20*b* becomes high.

A shape of the groove 31 is not limited to a cross as long as the pressure receiving area due to the pressure oil from the oil passage 20*b* is increased. Alternatively, an oil groove 34 may be formed in the cylinder bottom 17, as shown in FIG. 6. In the embodiment, the cross-shaped groove 31 and the oil groove 34 are disposed. However, if any other configuration or the like prevents a piston from springing out, the cross groove 31 or the oil groove 34 may be omitted.

A perforation 30 may be made in part of the disk spring 27 so that even if the disk spring 27 and the plate 25 remain in close contact with each other when the stroke of the piston 12 returns, pressure oil is allowed to easily enter an area of between close contact faces. The pressure oil introduced from a periphery of the plate 25 and through a hole 25*a* for inserting the support member 26 therein with an allowance can be introduced, through the perforation 30, into the gap between the disk spring 27 and the plate 25. Consequently, the disk spring 27 elastically returns such that the gap between the plate 25 and the piston end or the gap between the plate 25 and the pressure-receiving plate 29 fitted to the piston end can be returned to an original width.

As described above, the plates 25, 35 can be disposed on both sides of the end faces of the piston 12. Alternatively, the plate 25, 35 can be disposed on one side of the end faces of the piston 12. The support member for guiding the plates 25 and 35 and disk springs 27 and 38 may be a member supporting the plunger 28 or may use the piston rod 13.

Where the plunger is omitted, the support member 26 may be disposed on an axis of the piston 12 or a plurality of support members may be concentrically disposed at regular interval around the axis of the piston 12.

Instead of the foregoing configuration of the support member 26, any configuration for the support member 26 can be adopted as long as each face of the plate and the end face of the piston 12 can be brought into contact with or separated from each other while the faces of the plates 25 and 35 are kept substantially parallel to the end face of the piston 12. Therefore, the support member according to the invention includes the piston rod 13, the member for supporting the plunger 28, etc.

Second Embodiment

FIGS. 7 to 10, 12 and 13 are cross-sectional views showing another embodiment according to the present invention. For a sake of easier explanation, FIGS. 7 to 10, 12 and 13 show positional relations between members in an exaggerated manner.

A distinguishing feature of the second embodiment resides in a configuration in which a plunger is not disposed on the support member 26 and, instead of the disk spring and/or disk springs, a coil spring or an elastic piece formed by cutting part of a plate is disposed. Other features are identical to those in the first embodiment. As to the features identical to those in the first embodiment, same reference numerals used in the first embodiment are used and explanations of the members are omitted.

Figure 7:
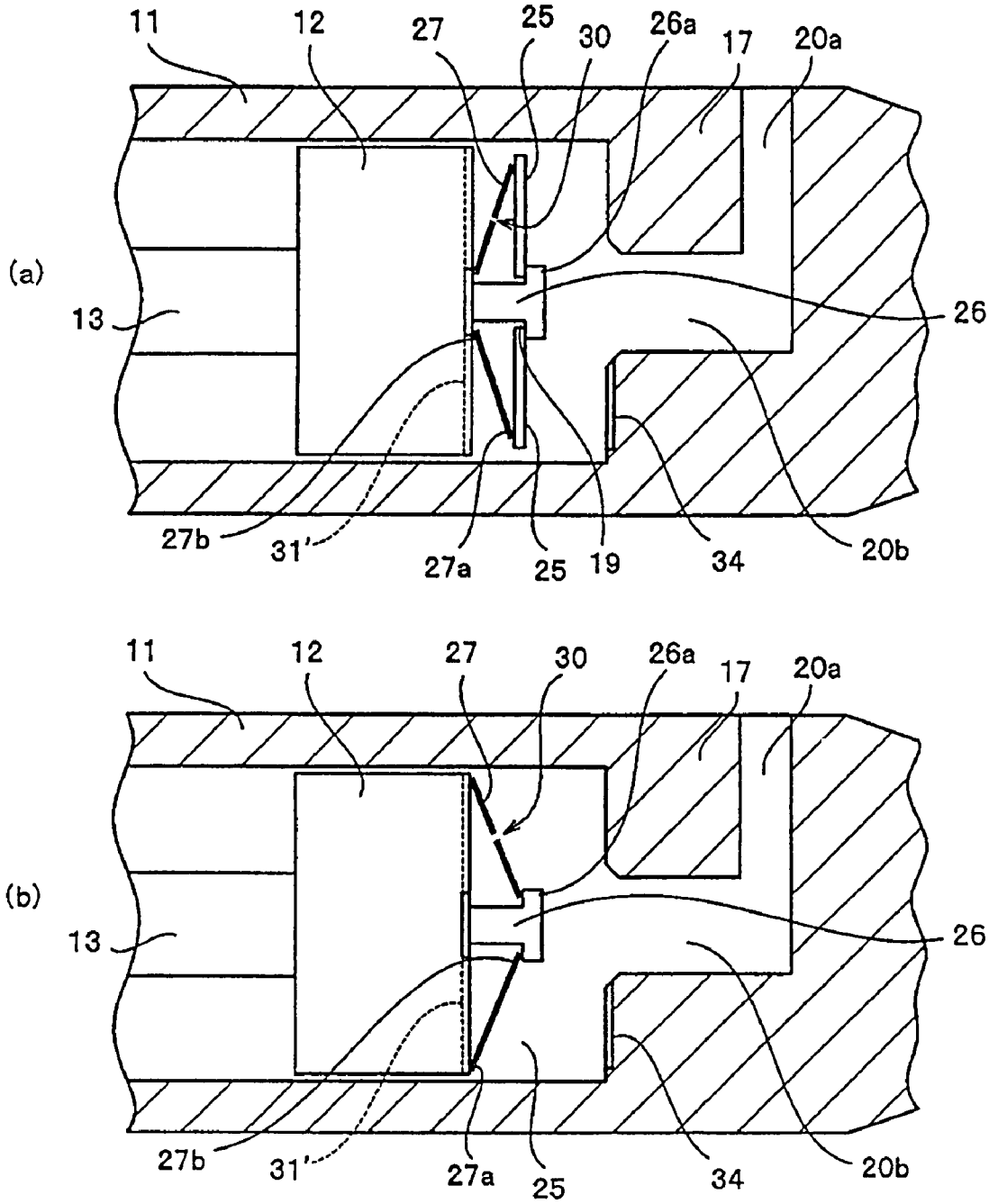
FIG. 7 is a schematic cross-sectional view of a main part of a hydraulic cylinder. (Second embodiment)

In FIG. 7(*a*), the plunger 28 used in the first embodiment is not disposed at a side of the leading end of the support member 26. Other features of the configuration are identical to those in the first embodiment shown in FIG. 3. In a vicinity of the stroke end of the piston 12, the leading end of the support member 26 can be inserted in the oil passage 20*b*.

When the plate 25 comes into contact with the cylinder bottom 17, an integral slide of the plate 25 with the piston 12 is stopped such that the gap between the plate 25 and the end face of the piston 12 is narrow. At this point, the plate 25 is in contact with the outer diameter portion 27*a* of the disk spring 27 while the inner diameter portion 27*b* of the disk spring 27 is in contact with the end face of the piston 12. Consequently, the disk spring 27 is deformed to be a flat plate state.

When the stroke of the piston 12 returns, the slide of the piston 12 can be caused by the oil groove 34 formed in the cylinder bottom 17. In FIG. 7(*a*), the disk spring 27 is disposed such that the inner diameter portion 27*b* of the disk spring 27 is on the side of the end face of the piston. However, the inner diameter portion 27*b* may be disposed on the side of the plate 25. In a disposition of the disk spring 27, as shown in FIG. 7(*a*), the disk spring 27 is in a plane contact with the end face of the piston 12 at the stroke end of the piston 12 on the side of the cylinder bottom.

Accordingly, even if a cross-shaped groove 31' is formed in the end face of the piston 12, the disk spring 27 is deformed and covers the cross-shaped groove 31', so that a squeeze effect is produced between the plate 25 and the disk spring 27 deformed and brought into plane contact with the end face of the piston 12. In addition, without forming in the disk spring 27 the perforation 30 used to return the disk spring, the cross-shaped groove 31' formed in the end face of the piston 12 is capable of releasing the close contact of the disk spring 27 with the end face of the piston 12. This enables the disk spring 27 to return to its original shape.

In addition, as shown in FIG. 7(*b*), the disk spring 27 can be given a function of the plate as well. In this case, the disk spring 27 functioning as the plate can exhibit a squeeze effect. Moreover, when the stroke of the piston 12 returns, the disk spring 27 functions as a spring that restores the gap between the end face of the piston 12 and the disk spring 27 itself.

In this case, as to a direction of the disk spring 27, it is preferable that the inner diameter portion 27*b* be disposed on a side of the flange 26*a* of the support member 26. The flange 26*a* of the support member 26 and the inner diameter portion 27*b* prevent the disk spring 27 from slipping out and deforming. When the piston 12 returns, the flange 26*a* of the support member 26 and the inner diameter portion 27*b* adjust the gap between the disk spring 27 and the end face of the piston 12 to be a desired width.

Figure 8:
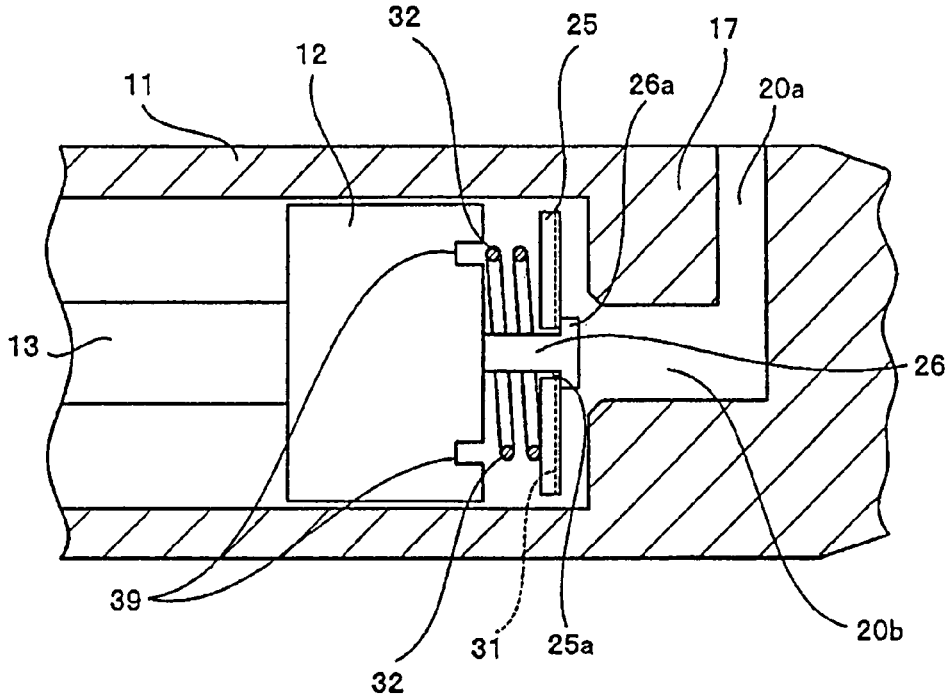
FIG. 8 is another schematic cross-sectional view of the main part of the hydraulic cylinder. (Second embodiment)

FIG. 8 shows an example using a coil spring instead of the disk spring. When the plate 25 moves toward the end face of the piston 12, the coil spring 32 can be accommodated in an annular groove 39 in the end face of the piston 12 while compressed by the plate 25. Accordingly, a gap between the plate 25 and the end face of the piston 12 can be narrow without being obstructed by the coil spring 32.

Instead of the coil spring 32, an elastic member such as a rubber member, an elastically deformable projecting member, or the like can be used. In a case that the elastic member such as a rubber member, the elastically deformable projecting member, or the like is used, a recess for accommodating a rubber member, projecting member, or the like is preferably formed in the end face of the piston 12 or the face of the plate opposite to the end face of the piston 12 so that a gap between the face of the plate and the end face of the piston 12 can be narrow as in a case where the coil spring 32 is used.

When the gap between the face of the plate and the end face of the piston 12 is narrow, a rubber member, a projecting member, or the like can be accommodated in the recess completely. Thus, the gap between the face of the plate and the end face of the piston 12 can be narrow. When the stroke of the piston 12 returns, a rubber member, a projecting member, or the like is projected from the recess, thereby restoring the gap between the plate 25 and the end face of the piston 12 to the desired width.

Figure 9:
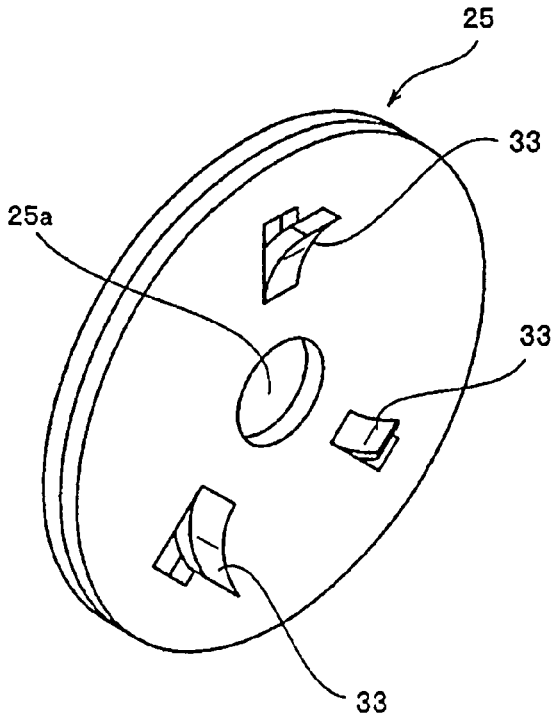
FIG. 9 is a perspective view of a plate. (Second embodiment)

Referring to FIG. 9, there is shown the plate 25 constructed as a two-layer structure plate such that parts of one of the plates are cut so as to form elastic flaps 33. The other plate is jointed to the plate in which the elastic flaps 33 are formed such that pressure oil does not escape in a direction of the piston shaft from cut portions forming the elastic flaps 33.

Figure 10:
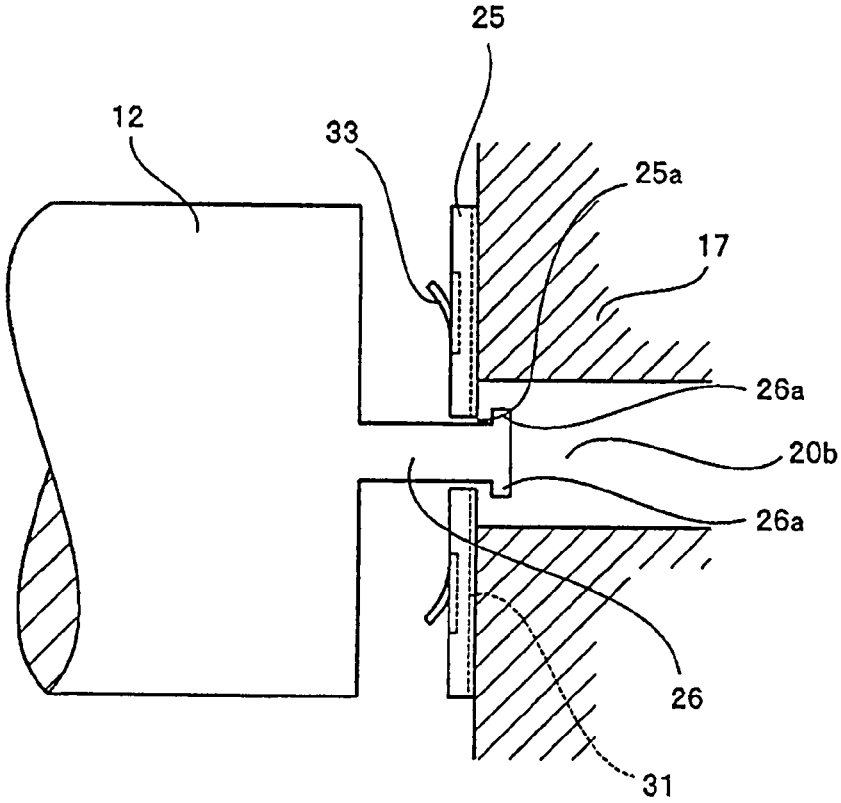
FIG. 10 is a schematic cross-sectional view of the main part of the hydraulic cylinder that uses the plate shown in FIG. 9. (Second embodiment)

FIG. 10 shows an example of a configuration in which the plate 25 shown in FIG. 9 is disposed on the support member 26. After the plate 25 comes into contact with the cylinder bottom 17 and the piston 12 slides further such that the gap between the plate 25 and the end face of the piston 12 is narrow, the elastic flaps 33 are accommodated in the face of the plate 25. This makes it possible to produce a squeeze effect between a face of the plate 25 and the end face of the piston 12. When the stroke of the piston 12 returns, an elastic force of the elastic flaps 33 increases a distance between the face of the plate 25 and the end face of the piston 12.

The plate on which the elastic flaps 33 are formed may be made of a synthetic resin material or a metal plate. Instead of forming the elastic flaps, a configuration may be modified such that when the stroke of the piston returns from the stroke end thereof, an appropriate gap is defined between the plate and the end face of the piston 12 by using the elastic force of the synthetic resin material.

Figure 12:
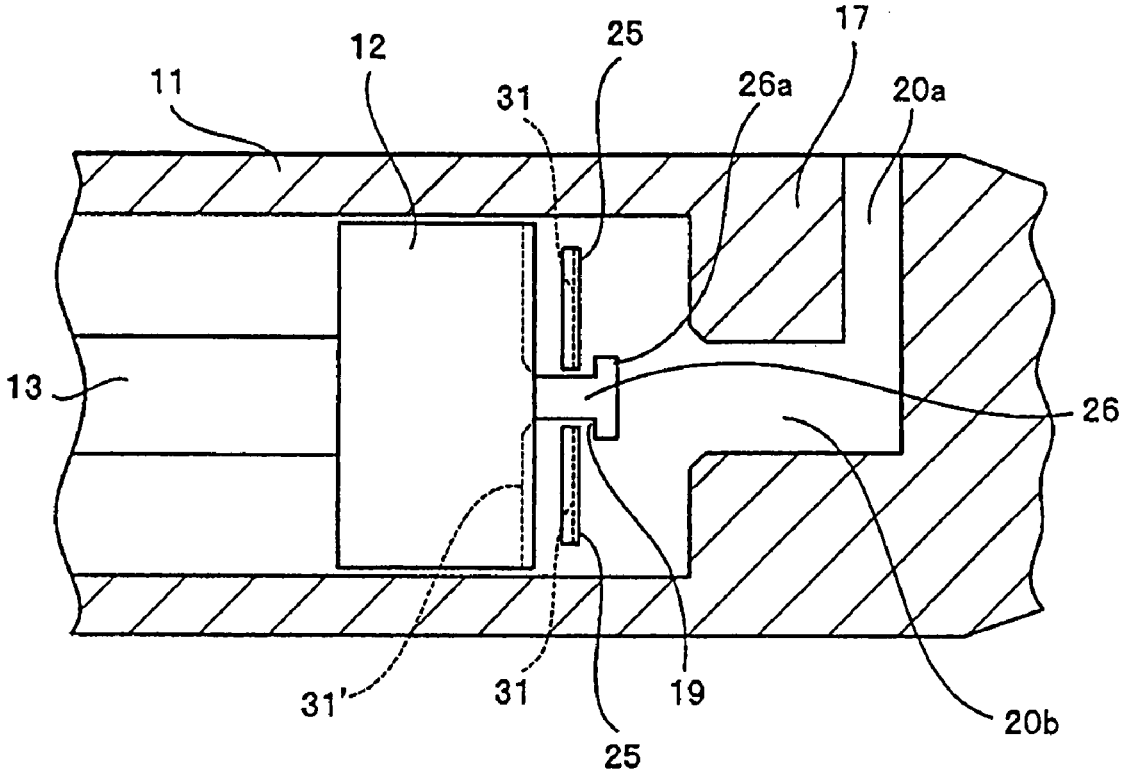
FIG. 12 is a schematic cross-sectional view of the main part of the hydraulic cylinder. (Second embodiment)

As a restoring mechanism for increasing the distance between the face of the plate 25 and the end face of the piston 12 when the stroke of the piston 12 returns, the cross-shaped grooves 31 formed in the face of the plate 25 and 31' formed in the end face of the piston 12, as shown in FIG. 12, may also be used instead of the elastic members described above.

In FIG. 12, the cross-shaped groove 31' of the piston 12 is wider than the cross-shaped groove 31 of the plate 25. In otherwords, as viewed from the front, an area of the cross-shaped groove 31' is greater than that of the cross-shaped groove 31. In addition, an outer diameter of the piston 12 is greater than that of the plate 25.

Figure 13:
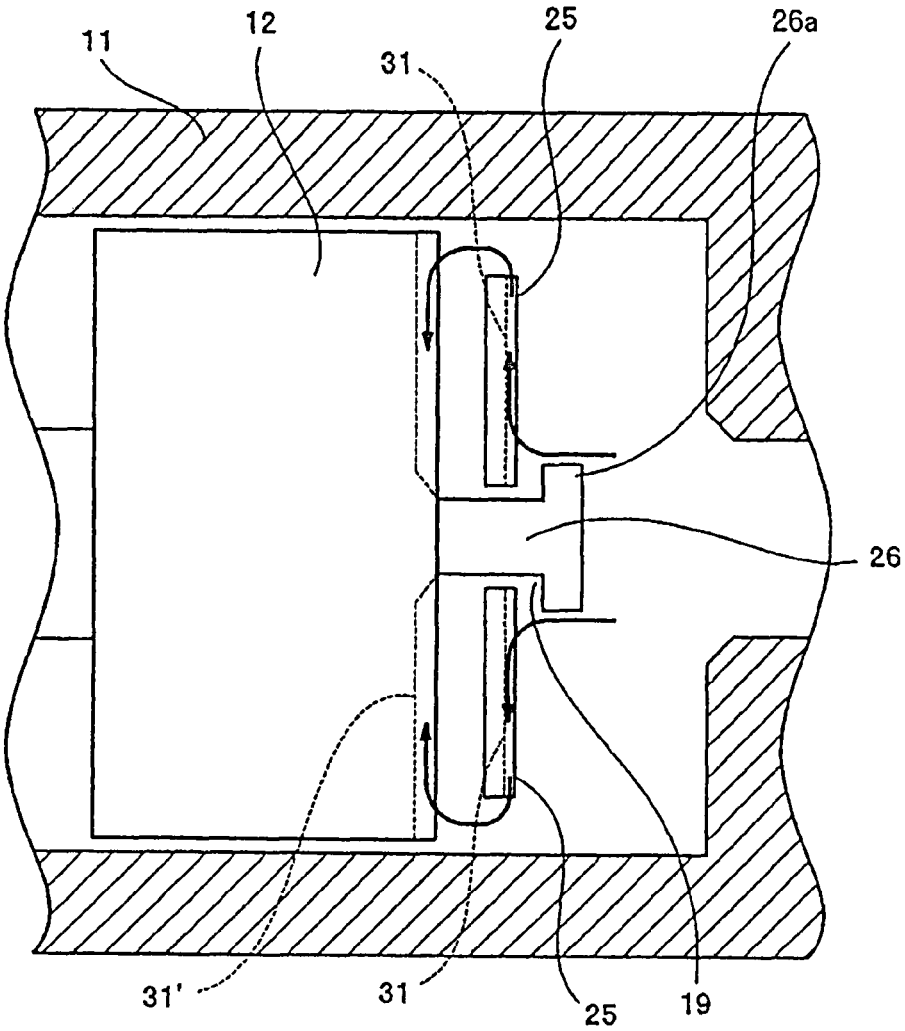
FIG. 13 is a view illustrating an operation of a plate with a cross-shaped groove. (Second embodiment)
Figure 14:
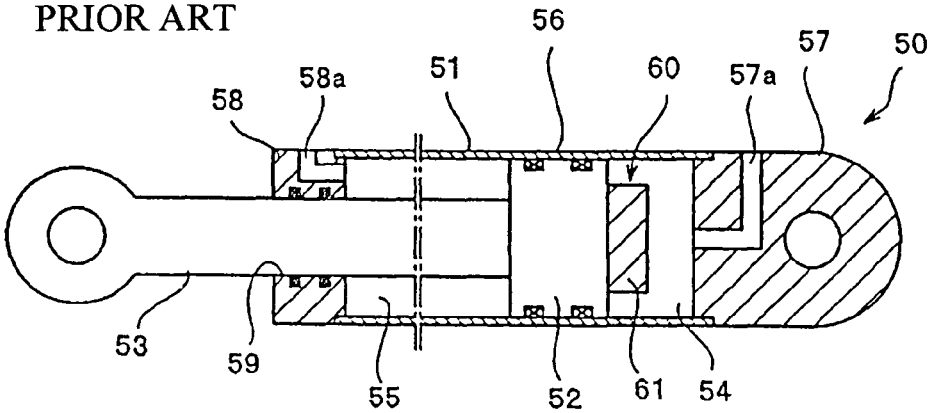
FIG. 14 PRIOR ART
FIG. 14 is a cross-sectional view of a hydraulic cylinder. (First conventional example)
Figure 15:
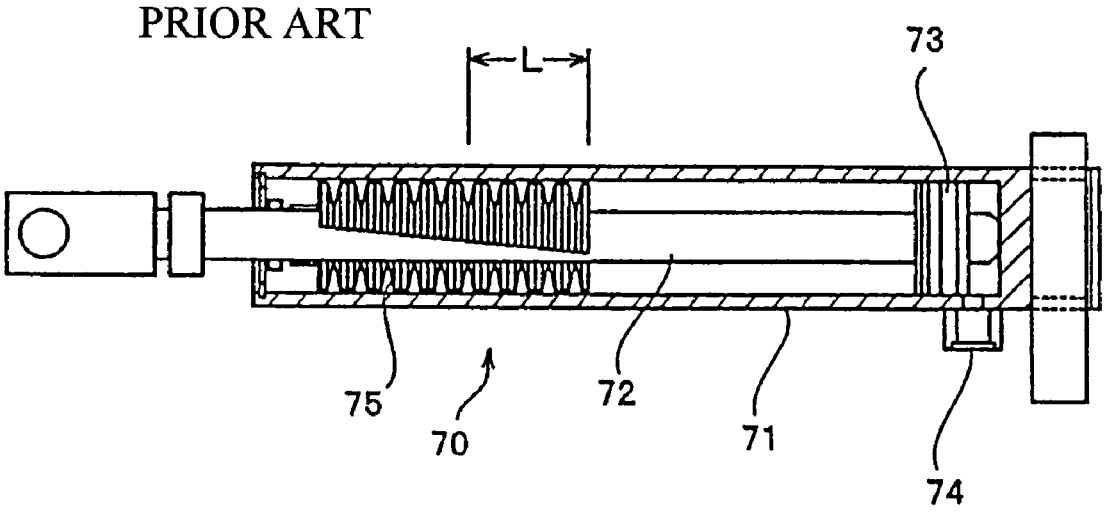
FIG. 15 PRIOR ART
FIG. 15 is a cross-sectional view of another hydraulic cylinder. (Second conventional example)

When the piston 12 slides and reaches its stroke end on the side of the cylinder bottom 17, the cylinder bottom 17, the plate 25, and the piston 12 are substantially in tight contact with one another. When the stroke of the piston 12 returns from this state, pressure oil is supplied from the oil passages 20*a* and 20*b*. As a result, as shown in FIG. 13, the pressure oil flows in the cross-shaped groove 31 of the plate 25 and reaches a periphery of the plate 25. The pressure oil is further introduced from the periphery of the plate 25 into the cross-shaped groove 31' formed in the end face of the piston 12.

By the pressure oil guided into the cross-shaped groove 31' formed in the end face of the piston 12, the piston 12 starts the return stroke. At this point, on account of a difference in the pressure receiving areas between the cross-shaped grooves 31 and 31', in other words, a difference in areas between the cross-shaped grooves as viewed from the front, a pressing force with which the plate 25 is separated from the piston 12 is greater than a pressing force with which the plate 25 is pressed toward the piston.

Accordingly, the plate 25 is moved in a reverse direction to a return direction of the piston 12 and hence the gap between the plate 25 and the end face of the piston 12 is restored.

Instead of forming the cross-shaped grooves 31 and 31' used to restore the plate 25 when the stroke of the piston 12 returns, an oil groove 34, as shown in FIG. 6, may be formed in the face of the plate 35, 25 brought into contact with the cylinder head 18 or the cylinder bottom 17 respectively. Alternatively, such an oil groove 34 may be formed in the cylinder head 18 or the cylinder bottom 17 opposite to the face of the plate 35, 25 respectively. Since the pressure oil supplied into the cylinder is introduced into the oil groove 34 and hence the pressure receiving area by the supplied pressure oil increases, sliding of the piston 12 can start smoothly.

Where an elastic body is used to restore the plates 25, 35, it is not necessarily to be a plate shape in which the elastic flaps are formed. Instead, the elastic body may have an outer shape as an abacus bead, which can be flattened by an application of external force. In this case, it is necessary that the elastic body can return to its original outer shape by its own elasticity when released from the external force.

Industrial Applicability

A technical concept of the present invention can be applied to various hydraulic cylinders required to produce an impact force by way of hydraulic cylinders and to prevent noises emitted by the impact.

The invention claimed is:

1. A hydraulic cylinder comprising:

a piston fitted within a cylinder so as to be slidable and a piston rod to one end of which the piston is fixed;

a plate disposed on a side of at least one of both end faces of the piston so as to be slid integrally with the piston and brought into contact with and separated from the one end face with a face of the plate being substantially parallel to the one end face, wherein the sliding of the plate is regulated relative to sliding of the piston at a stroke end of the piston;

a narrow gap defined between the face of the plate and the end face of the piston opposite to the plate by a regulation of the sliding of the plate, the gap configured to produce a squeeze effect; and a groove for a return stroke of the piston, the groove being defined in the face of the plate that is brought into contact with a cylinder head or a cylinder bottom or in the cylinder head or the cylinder bottom opposite the face of the plate.

2. The hydraulic cylinder according to claim 1, further comprising a restoring mechanism that restores the narrow gap between the face of the plate and the end face of the piston opposite to the plate to a desired width.

3. The hydraulic cylinder according to claim 2, wherein the restoring mechanism is an elastic member disposed between the face of the plate and the end face of the piston opposite to the plate.

4. The hydraulic cylinder according to claim 3, wherein the elastic member is a disk spring.

5. The hydraulic cylinder according to any one of claims 1 to 4, wherein the plate is formed from resilient synthetic resin.

6. The hydraulic cylinder according to any one of claims 1-4, wherein a plunger is disposed on a side of the cylinder bottom of the piston so as to be insertable in an oil passage opened in the cylinder bottom.

7. The hydraulic cylinder according to claim 5, wherein a plunger is disposed on a side of the cylinder bottom of the piston so as to be insertable in an oil passage opened in the cylinder bottom.

8. The hydraulic cylinder of claim 1, wherein the groove for the return stroke of the piston is defined in the face of the plate that is brought into contact with the cylinder head.

9. The hydraulic cylinder of claim 1, wherein the groove for the return stroke of the piston is defined in the face of the plate that is brought into contact with the cylinder bottom.

10. The hydraulic cylinder of claim 1, wherein the groove for the return stroke of the piston is defined in the cylinder head that is opposite the face of the plate.

11. The hydraulic cylinder of claim 1, wherein the groove for the return stroke of the piston is defined in the cylinder bottom that is opposite the face of the plate.

12. A hydraulic cylinder comprising:

a piston fitted within a cylinder so as to be slidable and a piston rod to one end of which the piston is fixed;

a support member extending from one end face of the piston in an axial direction, the support member being provided on at least one end face of both end faces of the piston;

a plate supported by the support member so that one face of the plate is brought into contact with or separated from the end face on which the support member is provided, the one face of the plate being substantially parallel to the end face, the plate being configured to both slide integrally with the piston and slide relative to the piston in the axial direction, wherein the sliding of the plate is regulated relative to the sliding of the piston at a stroke end of the piston;

a narrow gap defined between the one face of the plate and the end face of the piston opposite to the plate by a regulation of the sliding of the plate, the gap configured to produce a squeeze effect; and a groove for a return stroke of the piston, the groove being defined in the face of the plate that is brought into contact with a cylinder head or a cylinder bottom or in the cylinder head or the cylinder bottom opposite the face of the plate.

13. The hydraulic cylinder of claim 12, wherein the groove for the return stroke of the piston is defined in the face of the plate that is brought into contact with the cylinder head.

14. The hydraulic cylinder of claim 12, wherein the groove for the return stroke of the piston is defined in the face of the plate that is brought into contact with the cylinder bottom.

15. The hydraulic cylinder of claim 12, wherein the groove for the return stroke of the piston is defined in the cylinder head that is opposite the face of the plate.

16. The hydraulic cylinder of claim 12, wherein the groove for the return stroke of the piston is defined in the cylinder bottom that is opposite the face of the plate.

17. A hydraulic cylinder comprising:

a piston configured to slidably fit within the cylinder;

a piston rod coupled to one end of the piston;

a plate slidably coupled to the piston, a face of the plate and an end face of the piston being substantially parallel and defining a gap therebetween, wherein when the piston is at a stroke end, (i) the plate comes in contact with at least one of a cylinder head and a cylinder bottom and (ii) the gap decreases; and a groove defined in a surface of the plate brought into contact with at least one of a cylinder head and a cylinder bottom, or in at least one of the cylinder head and the cylinder bottom opposite the surface of the plate.

18. The hydraulic cylinder of claim 17, wherein the groove is defined in the surface of the plate brought into contact with the cylinder head.

19. The hydraulic cylinder of claim 17, wherein the groove is defined in the surface of the plate brought into contact with the cylinder bottom.

20. The hydraulic cylinder of claim 17, wherein the groove is defined in the cylinder head opposite the surface of the plate.

21. The hydraulic cylinder of claim 17, wherein the groove is defined in the cylinder bottom opposite the surface of the plate.

* * * * *